United States Patent [19]

Hoppe

[11] 4,292,747

[45] Oct. 6, 1981

[54] COMPRESSED AIR DREDGE

[75] Inventor: Walter Hoppe, Düren, Fed. Rep. of Germany

[73] Assignee: Zimmermann & Jansen GmbH, Düren, Fed. Rep. of Germany

[21] Appl. No.: 35,165

[22] Filed: May 2, 1979

[30] Foreign Application Priority Data

May 8, 1978 [DE] Fed. Rep. of Germany ..... 2820024

[51] Int. Cl.[3] ..... F04F 1/08; F04F 1/10; E02F 3/88

[52] U.S. Cl. ..... 37/58; 55/DIG. 17; 137/567; 417/426

[58] Field of Search ..... 37/59, 58; 55/DIG. 17; 137/567, 566; 417/426–429

[56] References Cited

U.S. PATENT DOCUMENTS 3,252,270 5/1966 Pall et al. ..... 55/DIG. 17
3,982,399 9/1976 Rookey ..... 137/567 X

FOREIGN PATENT DOCUMENTS 672271 10/1963 Canada ..... 417/426
2436061 2/1975 Fed. Rep. of Germany ..... 37/59

OTHER PUBLICATIONS

*Trane Refrigeration Manual,* Chapter VI "Multiple Compressor Systems", pp. 17–20, Copyright 1946.

*Primary Examiner*—Clifford D. Crowder
*Attorney, Agent, or Firm*—Allison C. Collard; Thomas M. Galgano

[57] ABSTRACT

A compressed air dredge for removing gravel, sand, mud or the like from the sea floor is provided of the type including a compressor which is installed on a dredging ship having a vertically-disposed feed pipe and which, via a compressed air line, blows compressed air into the bottom end of the feed pipe so as to provide the required suction force. The dredge is characterized by the provision of at least two vertically disposed feed pipes, each of which is coupled to a separate compressor and each of which is provided with a separate compressed air line. The compressed air lines are coupled together via a coupling line having shut-off means for establishing and closing-off communication between the two compressed air lines. The compressed air lines are also each provided with separate shut-off means disposed in the flow direction of the compressed air in the compressed air line, downstream of the coupling line, for establishing and closing off communication between the compressed air line and its associated feed pipe.

4 Claims, 3 Drawing Figures

COMPRESSED AIR DREDGE

The invention relates to a compressed air dredge for removing gravel, sand and mud, or the like from the bed of a body of water or sea floor. More particularly, it relates to a dredging device which is installed on a dredging ship having a vertical feed pipe, which device includes a compressor for blowing compressed air into the feed pipe from the lower end of a compressed air line so as to provide the required suction force. Two or a plurality of such vertical feed pipes are each provided with one associated compressor, whereby the compressed air lines of at least two compressors are coupled with each other by means of a closeable coupling line. The compressed air lines are also individually closeable, downstream of the location of the coupling line.

The known compressed air dredges were very successful, in particular at very great depths. However, one difficulty, which exists with such dredges is that the feed pipe may become plugged up when the material to be dredged is composed of an unfavorable material, for example, when larger cohesive clumps appear or if the material contains too much mud or fine sand. In order to open the feed lines it usually suffices to increase the quantity of pressure of the fed compressed air for a short while. Therefore, the removal of the obstruction is not too difficult in cases where the compressor has a corresponding power reserve. This power reserve should be at least 25% of the capacity which is used for normal operating conditions. Naturally, it would be even better if the power reserve would be 50% of the normal operating capacity for very difficult situations.

Such power reserves for compressors mean a considerable expense for the compressor itself, the associated operating motor, the required couplings etc. This necessary expenditure is very high with compressed air dredges having a high operating capacity.

It is therefore an object of the invention to provide a high-powered, compressed air dredge, wherein an additional power reserve for the purpose of removing obstructing or interferring material is not required for the compressor, but which can fulfill the functions of the above-mentioned types of dredges.

This object of the invention is achieved in accordance with the present invention by the provision of a compressed air dredge of the aforementioned type wherein two or a plurality of feeding pipes are each provided with one associated compressor, with the compressed air lines of at least two compressors being coupled with each other by means of a closeable coupling line and being individually closeable, downstream of the location of the coupling line.

The capacity of each of the compressors corresponds to the normal requirement of each associated feed pipe in accordance with the compressed air dredge. When an obstruction occurs, the total capacity of two compressors may be fed to one feed pipe by means of the coupling line, so that a power reserve of 100% is present, with respect to the normal power capacity. However, during the obstruction period, the other pipe must be switched off. Since the mentioned obstructions rather seldom occur, a very short interruption in the operation of the pipe may be tolerated while the obstruction in the other pipe is removed.

In a further embodiment of the invention, the shut-off elements in the coupling line and/or the compressed air lines are controllable throttle elements. Thereby, it is possible to increase the air pressure supply of one feed pipe without completely shutting off the other feed pipe. Therefore, the controlled throttle elements permit supply of the compressed air quantity in such a way that the feeding requirements of both pipes can be taken into consideration.

Furthermore, it is advantageous to provide oil separators in the compressed air lines in front of or upstream of the connections or the branches of the coupling line. These oil separators prevent oil from entering the water from the compressed air lines. The suggested disposition of the oil separators in front of the branch of the coupling line assures that each oil separator is only admitted by the air quantity delivered from one compressor, so that the oil separators are not overcharged.

Furthermore, the compressed air lines are preferably guided outside of the dredge ship through the water and then to the oil separators. This disposition of the compressed air lines is advantageous in that the compressed air is cooled off before entering into the oil separators, so that any oil vapors in the compressed air line are condensed and separated in the oil separator.

Other objects and features of the present invention will become apparent from the following detailed description considered in connection with the accompanying drawings which disclose one embodiment of the invention. It is to be understood, however, that the drawings are designed for the purpose of illustration only and not as a definition of the limits of the invention.

In the drawings, wherein similar reference characters denote similar elements throughout the several views.

Figure 2:
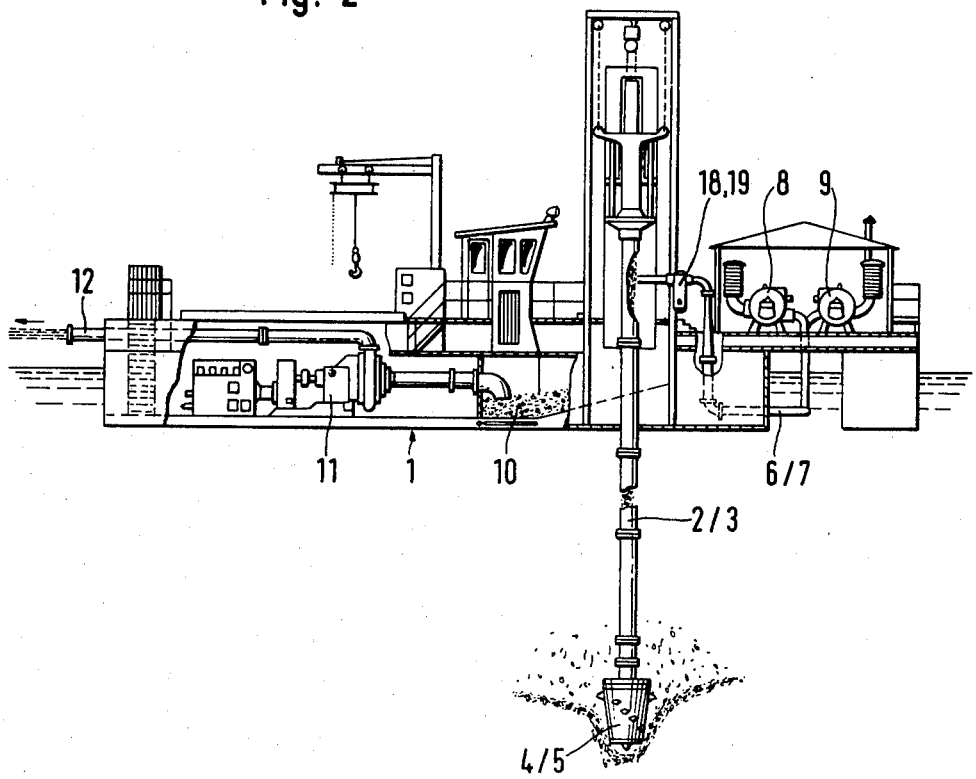
FIG. 2 is a fragmentarily-illustrated side view of a dredging ship on which the dredging apparatus is mounted.
Figure 3:
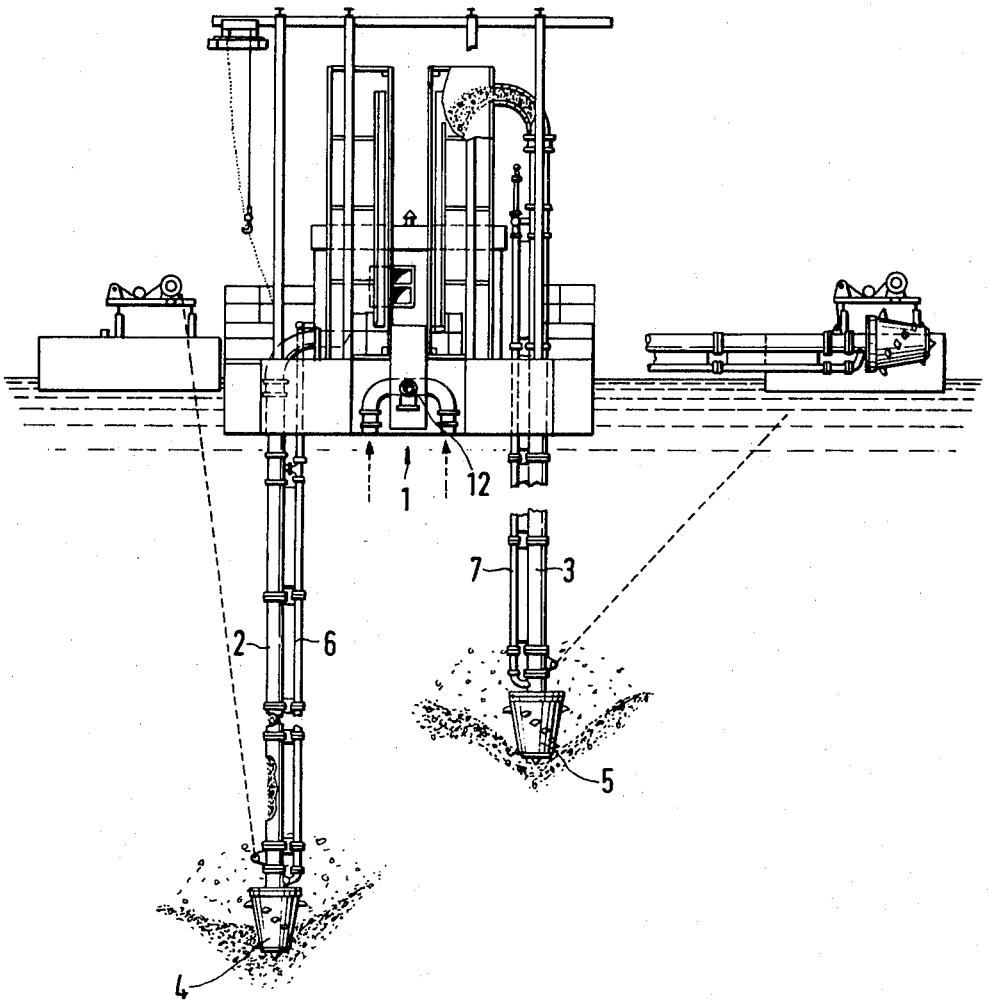
FIG. 3 is a fragmentarily-illustrated front view of the dredging ship shown in FIG. 2.

Turning now in detail to the drawings and, in particular, FIGS. 2 and 3, therein illustrated is a dredge or dredging ship 1 on which are mounted two slideable or movable vertical pipes 2 and 3. Rotatable cutting heads 4 and 5 are mounted on the lower ends of feed pipes 2 and 3. Furthermore, compressed air lines 6 and 7 are mounted on the feed pipes 2 and 3 which feed compressed air to the lower ends of feed pipes 2 and 3 by means of compressors 8 and 9. The compressed air which is blown into feed pipes 2 and 3 reduces the specific weight of the feed mixture which is present in pipes 2 and 3, so that this feed mixture is subjected to an upward movement in accordance with the so-called "mammoth-airlift pump" principle. The feed mixture which is discharged at the upper end of the feed pipes 2 and 3 is fed to a pump sump and is suctioned off from this sump by means of a feed pump 11 and a connecting pipeline 12.

Figure 1:
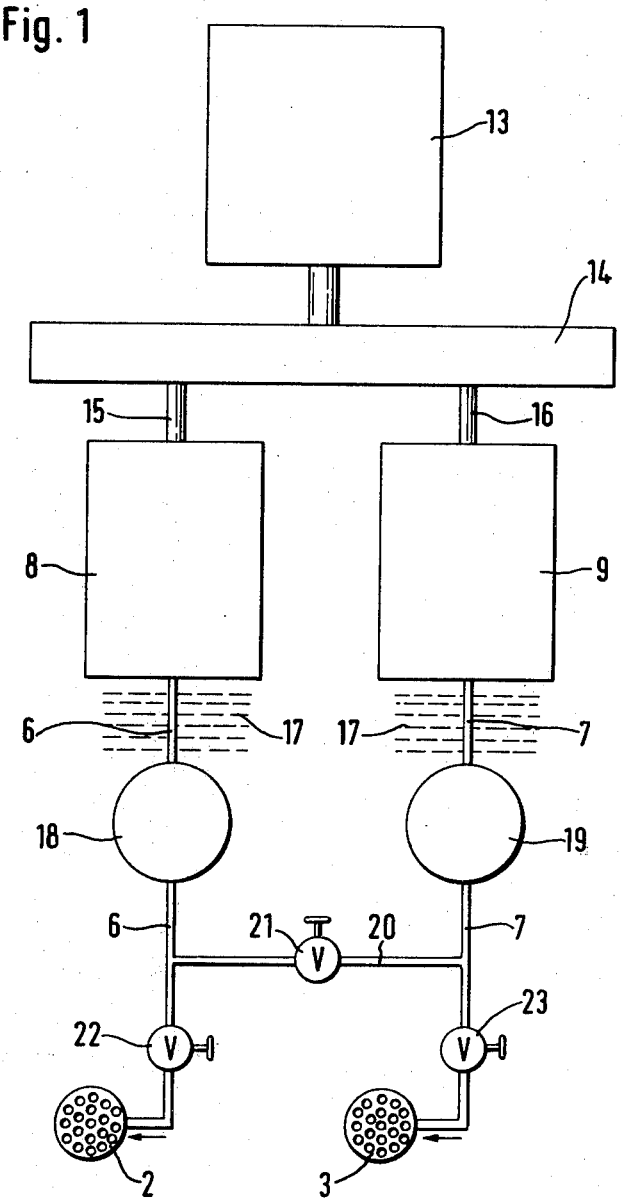
FIG. 1 is a schematic representation of a dredging apparatus embodying the present invention illustrating the compressors and the compressed air supply to the feed pipes.

In accordance with the invention, the desired compressed air supply for feed pipes 2 and 3 is provided by compressors 8 and 9, shown schematically in FIG. 1. The two compressors 8 and 9 are driven by a common drive motor 13 and a drive 14 having two drive shafts 15 and 16. Naturally, both compressors may be driven by a separate motor. The compressed air lines 6 and 7 which start at the compression side of compressors 8 and 9 are guided outside of the dredging ship 1 and through the water 17 (see FIG. 2). Consequently, the compressed air undergoes a cooling off, so that any subsequently present oil vapors form a condensate which can be separated in oil separators 18 and 19 which are incorporated in compressed air lines 6 and 7, respectively. Compressed air lines 6 and 7 are coupled together by means of a coupling line 20 located downstream in the flow direction behind or below the oil separators 18 and 19. A controllable throttle valve or element 21 which also serves as a shut-off element 21 is provided in the coupling line 20. Furthermore, throttle elements 22 and 23, which are also shut-off elements, are installed in the flow direction below or behind the coupling positions or connections of the coupling line 20 to compressed air lines 6 and 7. By means of these throttle elements 22 and 23, the air supply to supply pipe 2 or 3, respectively, may be completely or partly closed.

If, for example, a plugging-up or obstruction occurs in feed pipe 2, which must be removed by an increased air supply, throttle element 21 must be completely or partly opened, while throttle element 23 is partly or completely closed. Thereby, the air quantity blown into feed pipe 2 is increased while the air quantity blown into feed pipe 3 is correspondingly reduced or completely shut off. Therefore, the total power of compressor 9 is available in addition to the power of compressor 8 for removing the obstruction in feed pipe 2. When obstructions occur in feed pipe 3 the same method is applied, that is, throttle element 21 is opened, while at the same time the throttle element 22 is closed.

The compressed air dredge in accordance with the invention as shown may be supplied with further supply pipes and associated compressors, wherein the compressed air supply is coupled to adjacent feeding pipes.

While only a single embodiment of the present invention has been shown and described, it will be obvious to those persons of ordinary skill in the art, that many changes and modifications may be made thereunto, without departing from the spirit and scope of the invention.

What is claimed is:

1. In a compressed air dredge for removing gravel, sand, mud or the like from the sea floor of the type including a compressor which is installed on a dredging ship having a vertically-disposed feed pipe and which, via a compressed air line, blows compressed air into the bottom end of the feed pipe so as to provide the required suction force, the improvement comprising:

at least two vertically-disposed feed pipes, each of which is coupled to a separate compressor and each of which is provided with a separate compressed air line, said compressed air lines being coupled together via a coupling line having shut-off means for establishing and closing off communication between said two compressed air lines and said compressed air lines also each being provided with separate shut-off means disposed, in the flow direction of said compressed air line, downstream of said coupling line, for establishing and closing off communication between the compressed air line and its associated feed pipe.

2. The dredge according to claim 1, wherein said shut-off means each comprise controllable throttle valves.

3. The dredge according to claim 1 or 2, wherein an oil separator is incorporated in each of said compressed air lines, upstream of said coupling line relative to the flow of the compressed air.

4. The dredge according to claim 3, wherein said compressed air lines include a section disposed upstream of said oil separators which is disposed for placement in the water so as to effect cooling and condensing of any oil vapors in said air line prior to passage of the air through said oil separators.

* * * * *